US006793521B1

(12) United States Patent
Smedberg

(10) Patent No.: US 6,793,521 B1
(45) Date of Patent: Sep. 21, 2004

(54) ANGLED CONNECTOR

(75) Inventor: Darin P. Smedberg, Petaluma, CA (US)

(73) Assignee: Calix Networks, Inc., Petaluma, CA (US)

( * ) Notice: Subject to any disclaimer, the term of this patent is extended or adjusted under 35 U.S.C. 154(b) by 0 days.

(21) Appl. No.: 10/051,940

(22) Filed: Jan. 16, 2002

(51) Int. Cl.[7] ..... H01R 13/58
(52) U.S. Cl. ..... 439/468; 439/299; 439/578
(58) Field of Search ..... 439/578, 579, 439/582, 445, 446, 369, 466, 468, 473, 299

(56) References Cited

U.S. PATENT DOCUMENTS

| | | | | | |
|---|---|---|---|---|---|
| 3,019,287 | A | * | 1/1962 | Newcomb, Jr. et al. | 439/125 |
| 3,963,291 | A | * | 6/1976 | Maloof | 439/28 |
| 3,975,075 | A | * | 8/1976 | Mason | 439/954 |
| 4,003,616 | A | * | 1/1977 | Springer | 439/23 |
| 4,106,831 | A | * | 8/1978 | Albrecht | 439/13 |
| 4,377,320 | A | | 3/1983 | Lathrop et al. | 439/578 |
| 4,412,717 | A | | 11/1983 | Monroe | 439/578 |
| 4,655,534 | A | | 4/1987 | Stursa | 439/578 |
| 5,447,454 | A | * | 9/1995 | Inaba et al. | 439/924.2 |
| 5,788,531 | A | * | 8/1998 | Wright et al. | 439/374 |
| 6,036,540 | A | | 3/2000 | Beloritsky | 439/582 |
| 6,106,333 | A | * | 8/2000 | Purdy | 439/578 |
| 6,350,147 | B2 | * | 2/2002 | Brownell et al. | 439/468 |
| 6,516,053 | B1 | * | 2/2003 | Ryan et al. | 379/21 |

OTHER PUBLICATIONS

"Trompeter", downloaded Nov. 16, 2001 from <http://www.trompeter.com/shop/ProductDetail.asp?ProdStock=UP-LFF220%2>, Trompeter Electronics, Inc. (2001).

Diagram, Trompeter Electronics, Inc.

"Interface Dimensions MIL–STD–348" AEP, p. 60.

"Cable Plugs Straight and Right Angle" AEP.

"SMB Connectors", downloaded Sep. 28, 2001 from <http://www.molex.com/product/rf/smb.html>, Molex Incorporated (2000).

"Coaxial Assemblies for DS–3 Interconnections" LoDan International Offices (Nov. 2000).

"Amphenol RF Connectors", downloaded Oct. 29, 2001 from <http://www.sescodatasystems.com/amphenol_rf_connectors.htm>, SESCO Data Systems.

"250 Series Mini–BNC (M–BNC)" Trompeter Electronics.

"Copper Assemblies", downloaded Oct. 29, 2001 from <http://www.csp.com/html/cp_products/copper_assemblies.html>, Computer Systems Products, Inc. (2001).

"Amphenol SMB/SMC Connectors", downloaded Oct. 29, 2001 from <http://www.sescodatasystems.com/amphenol/smb_smc.html>, SESCO Data Systems.

* cited by examiner

*Primary Examiner*—P. Austin Bradley
*Assistant Examiner*—Briggitte R. Hammond
(74) *Attorney, Agent, or Firm*—Silicon Valley Patent Group LLP

(57) ABSTRACT

In accordance with this invention, an angled female SMB plug includes a first tubular main body and a tubular wire exit extending approximately 45 degrees from the main body. The main body is chamfered at one end to produce a flat end surface that is approximately parallel with the wire exit. The outer diameter of the main body is approximately 89 percent of a pitch between adjacently mounted plugs and the outer diameter of the wire exit is approximately 59 percent of the same pitch.

16 Claims, 4 Drawing Sheets

ANGLED CONNECTOR

FIELD OF THE INVENTION

This invention relates to coaxial cable connectors and in particular to such a connector wherein the coaxial cable exits from the body of the connector at an angle, thereby to increase the accessibility of each connector and to decrease the protrusion depth associated with groups of such connectors.

DESCRIPTION OF RELATED ART

Coaxial assemblies for telecommunication applications, such as DS-3 include many forms: straight, right angle, 735A cable, RG 179 single shield, RG 179 double shield, positive latch SMB and conventional SMB (wherein "SMB" stands for Sub-Miniature-type B). SMB connectors were developed to provide a quick connect/disconnect interface with a push on/pull off capability. SMB connectors conform to the requirements of a military specification MIL-C-39012 and the interface is in compliance with a military specification MIL-STD-348. Normally a female SMB connector (e.g., a SMB plug) plugs onto a male SMB connector (e.g., a SMB jack). SMB connectors may be used to couple two networking equipment using coaxial copper cables. In one application, SMB plugs at the ends of coaxial cables are connected to SMB jacks on a printed circuit board (PCB) of a universal access platform or other networking equipment, at a central office of a service provider or a remote box at a customer site. Such a PCB includes rows and columns of SMB jacks packed closely together to reduce space usage. Typically, the coaxial cables are attached to the plug either perpendicularly or coaxially with the axis of the plug. However, a perpendicular attachment limits the density of plugs which be attached to a PCB and thus requires a larger area than desired for a given number of plugs. The coaxial attachment results in coaxial cables protruding into an aisleway where the cables might be bumped and thus dislodged or broken.

The prior art includes what is known as a Bayonet-Neill-Concelman coupling mechanism wherein a rotatable collar is inserted over a male fitting and rotated approximately a quarter turn to lock protrusions on the male fitting into angled slots on the rotatable collar. The coaxial cable exits from the body of the structure supporting the rotatable collar at an angle, such as 45°. However, this structure is bulky and large so as to be able to be turned by a person's fingers, and thus this structure is capable of being used only in low density applications.

SUMMARY OF THE INVENTION

In accordance with some embodiments of the invention, a SMB plug has two portions that are angled relative to one another, specifically a main body and a wire exit extending approximately 45 degrees from the main body. Presence of such an angle allows the pitch of a two dimensional array of angled SMB plugs to be smaller than in the prior art, resulting in an increased density and increased reliability than the industry currently offers. The angled structure of the SMB plugs of the type described herein also allows easy management (mounting and dismounting) independent of one another. The main body is tubular and has a diameter that is approximately 89 percent of a pitch between (i.e. the distance between the centerlines of) two SMB plugs mounted adjacent to each other (hereafter "adjacent SMB plugs") in one specific embodiment. The wire exit is also tubular and has a diameter that is approximately 59 percent of the pitch between two adjacent SMB plugs in this particular embodiment. Such dimensional relations apply only to a 45° angle plug and can be different in other embodiments.

The dimensions of the angled SMB plug are selected to create sufficient clearance between adjacent angled SMB plugs in a two dimensional array to allow each angled SMB plug to rotate to the right or the left without interfering with adjacent angled SMB plugs in the same column. The angle between the coaxial cable exiting from the plug and the centerline of the plug reduces the protrusion depth of the coaxial cables connected to the plug compared to cables coaxially aligned with the plugs and thus reduces the possibility of damage or inadvertent disconnecting or breaking of a plug. Thus, cables of all but one SMB plug in a group of SMB plugs in a two dimensional array can be rotated away (in different directions), to make room for a person's hand (or a tool) to hold and dismount the unrotated SMB plug. Thus any SMB plug can be mounted or dismounted without affecting any other SMN plug. In one embodiment, cables exit at 45° from the plugs thereby reducing coaxial cable protrusion by approximately 50% compared to cables coaxially aligned with the plugs.

DETAILED DESCRIPTION

Figure 1:
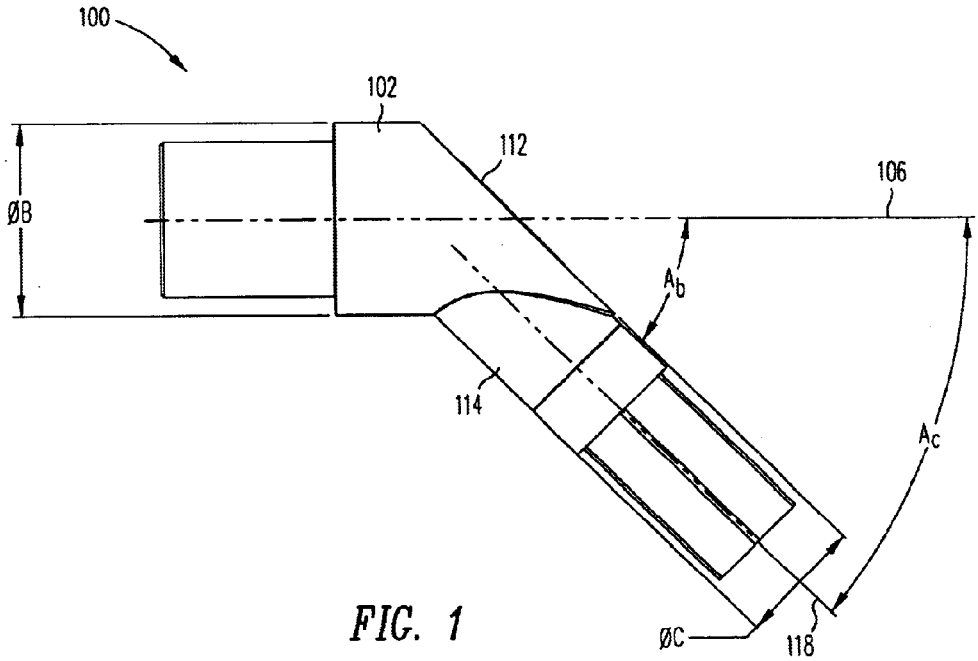
FIG. 1 shows a side view of an angled SMB plug in accordance with some embodiments of the invention.

FIG. 1 shows an angled female SMB coaxial plug 100 of certain embodiments of the invention. Plug 100 includes (1) a tubular main body 102 along an axis 106, and (2) a tubular wire exit 114 extending from main body 102 along an axis 118. In one embodiment, an angle $A_C$ between axes 106 and 118 is 45° although other embodiments use any value in the range of 45°±20° (depending on diameter C) (FIG. 1). Main body 102 is chamfered to produce an end surface 112 at an end that is to be located away from a printed circuit board to which plug 100 will be coupled. In one embodiment, an angle $A_b$ between end surface 112 and axis 106 is also 45°, and again other embodiments may use a value in the range 45°±20°. The specific angles may be chosen to be of any value so long as end surface 112 is parallel (or substantially parallel) with wire exit 114. (within±50°.)

Main body 102 includes a snap on coupling mechanism that allows plug 100 to be quickly connected and disconnected from a male SMB jack. The snap-on coupling mechanism is different from, e.g., a Bayonet-Neill-Concelman coupling mechanism found in BNC connectors but similar or equal to standard SMB plugs.

Main body 102 has an outer diameter B and wire exit 114 has an outer diameter C. In one embodiment where angle A=45°, outer diameter B is at most 89% of a pitch P and outer diameter C is at most 59% of pitch P. Pitch P is the smaller of a pitch $P_X$ along the x-axis and a pitch $P_y$ along the y-axis of a two dimensional array of SMB jacks on a printed circuit board (described later). Note that $P_X$ and $P_y$ can be equal, depending on the embodiment.

Angle $A_b$ between main body 102 and wire exit 114 allows a number of such plugs 100 to be mounted in a two dimensional array at a pitch P smaller than the prior art pitch required between adjacent prior art 90° plugs. At the same time an angled plug 100 of the type described herein facilitates easy management of cables exiting the plugs 100 when mounted in a two dimensional array (at the same pitch in both dimensions).

Figure 5A:
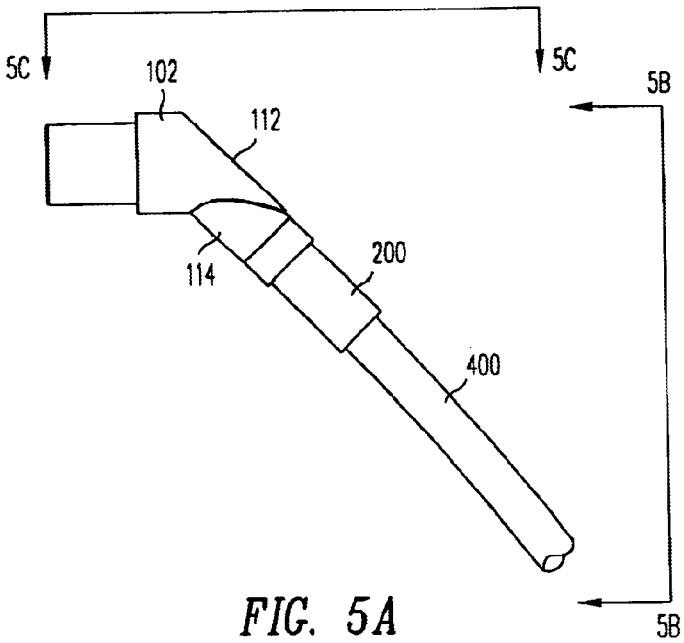
FIG. 5A shows a side view of the SMB plug with an attached coaxial cable in one embodiment.
Figure 5B:
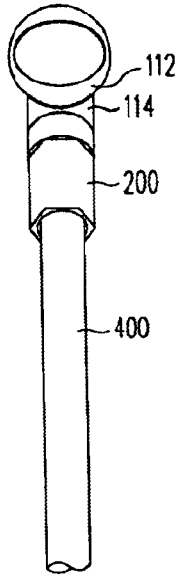
FIG. 5B shows a back view of the SMB plug along line 5B—5B in FIG. 5A in one embodiment.
Figure 5C:
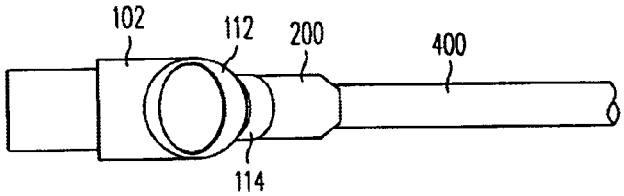
FIG. 5C shows a top view of the SMB plug along line 5C—5C in FIG. 5A in one embodiment.
Figure 5D:
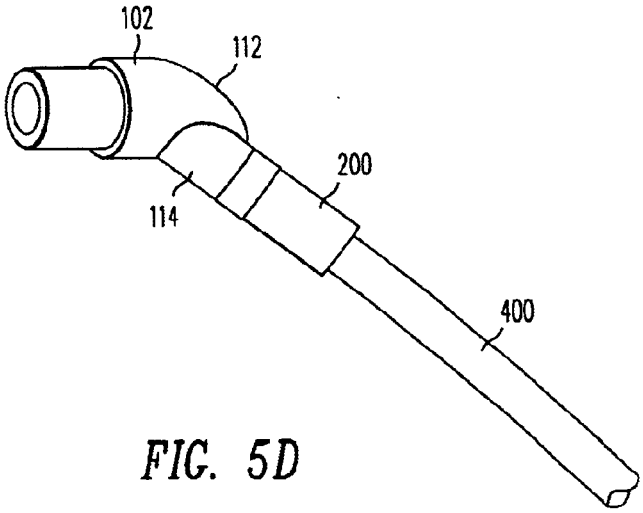
FIG. 5D shows a perspective view of the SMB plug in one embodiment.

For clarity, FIGS. 5A to 5D show additional views of plug 100. FIG. 5A shows a side view of plug 100 with a coaxial cable 400 attached to wire exit 114 by an optional ferrule 200. In other embodiments coaxial cable 400 can be attached to wire exit 114 by other means. FIG. 5B shows a back view of plug 100 along line 5B—5B in FIG. 5A FIG. 5C shows a top view of plug 100 along line 5C—5C in FIG. 5A FIG. 5D shows a perspective view of plug 100. Visible in all these views is the chamfering of main body 102 that produces end surface 112 that is at least substantially parallel with wire exit 114.

Figure 2:
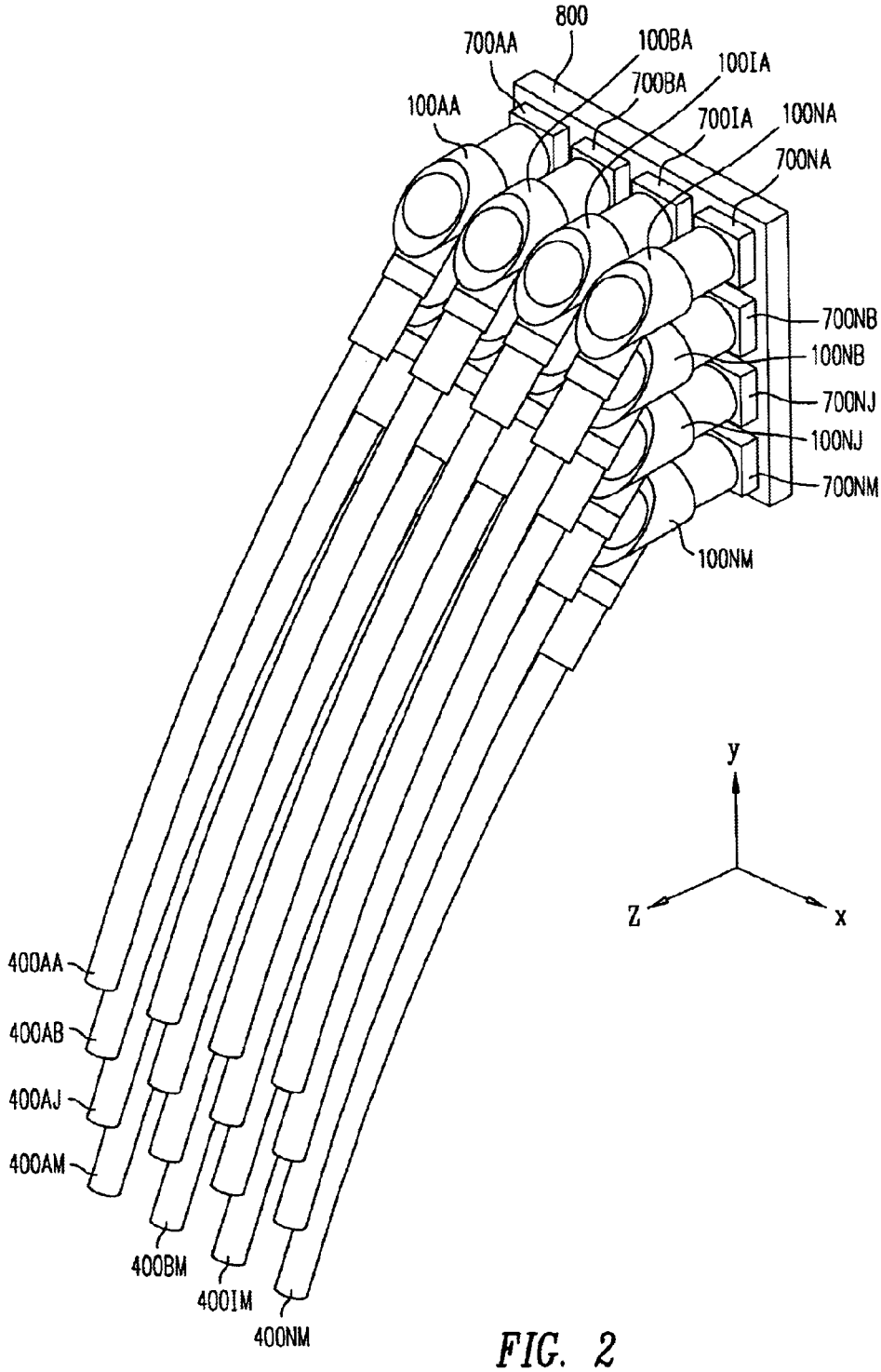
FIG. 2 shows a perspective view of columns and rows of the SMB plugs of FIG. 1 mounted to a printed circuit board in one embodiment.

FIG. 2 shows a perspective view of multiple plugs 100xy (where x and y respectively denote the column and row positions of the connector) mounted to a PCB 800. As can be seen, coaxial cables 400xy from plugs 100 trail off at an angle initially at 45 degrees relative to PCB 800. When PCB 800 is vertically mounted to a rack of networking equipment and the workspace between racks is minimal, the angled coaxial cables 400 from plugs 100 are less likely to protrude for a large distance from PCB 800 as compared to prior art, and, intrude less into the workspace and a craftsperson is less likely to accidentally bump into and damage or detach the coaxial cables. Furthermore, the gentle angle at which coaxial cables 400 trail off causes less strain on the coaxial cables, as compared to the prior art.

Figure 3:
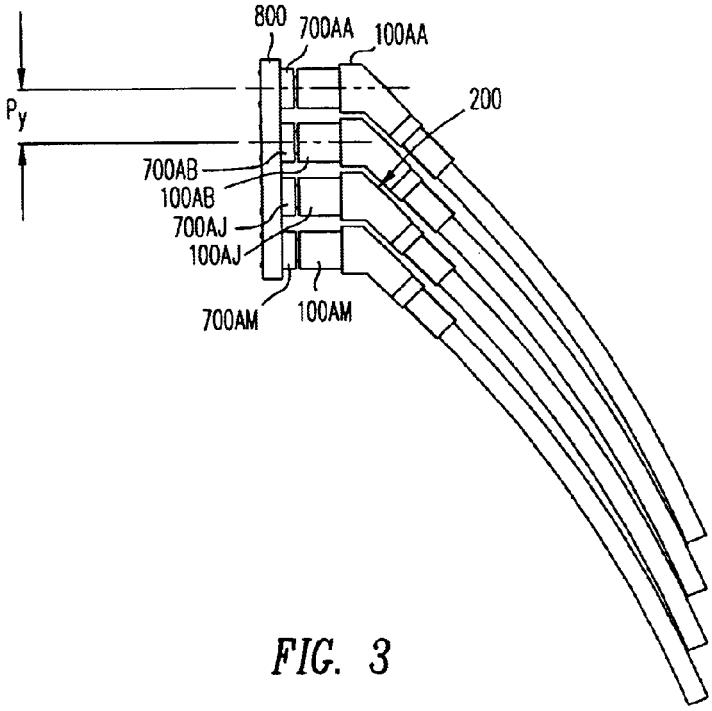
FIG. 3 shows a side view of several angled SMB plugs of FIG. 1 mounted on to a column of SMB jacks on a printed circuit board in one embodiment.

FIG. 3 shows a side view of a column of a two dimensional array of angled SMB plugs 100 mounted to multiple SMB coaxial jacks 700. Jacks 700 are located on PCB 800 in one embodiment. Jacks 700 are separated by pitch $P_y$ (e.g., 0.350 inches). As can be seen in FIG. 3, adjacent plugs 100AB and 100AJ are separated by a clearance 200 between end surface 112 of plug 100AB and wire exit 114 of plug 100AJ created from angles $A_b$ and $A_c$, and diameters B and C. Thus, each plug 100 can rotate at least 90° to the right or the left without interfering with adjacent plugs 100 in the same column.

Figure 4:
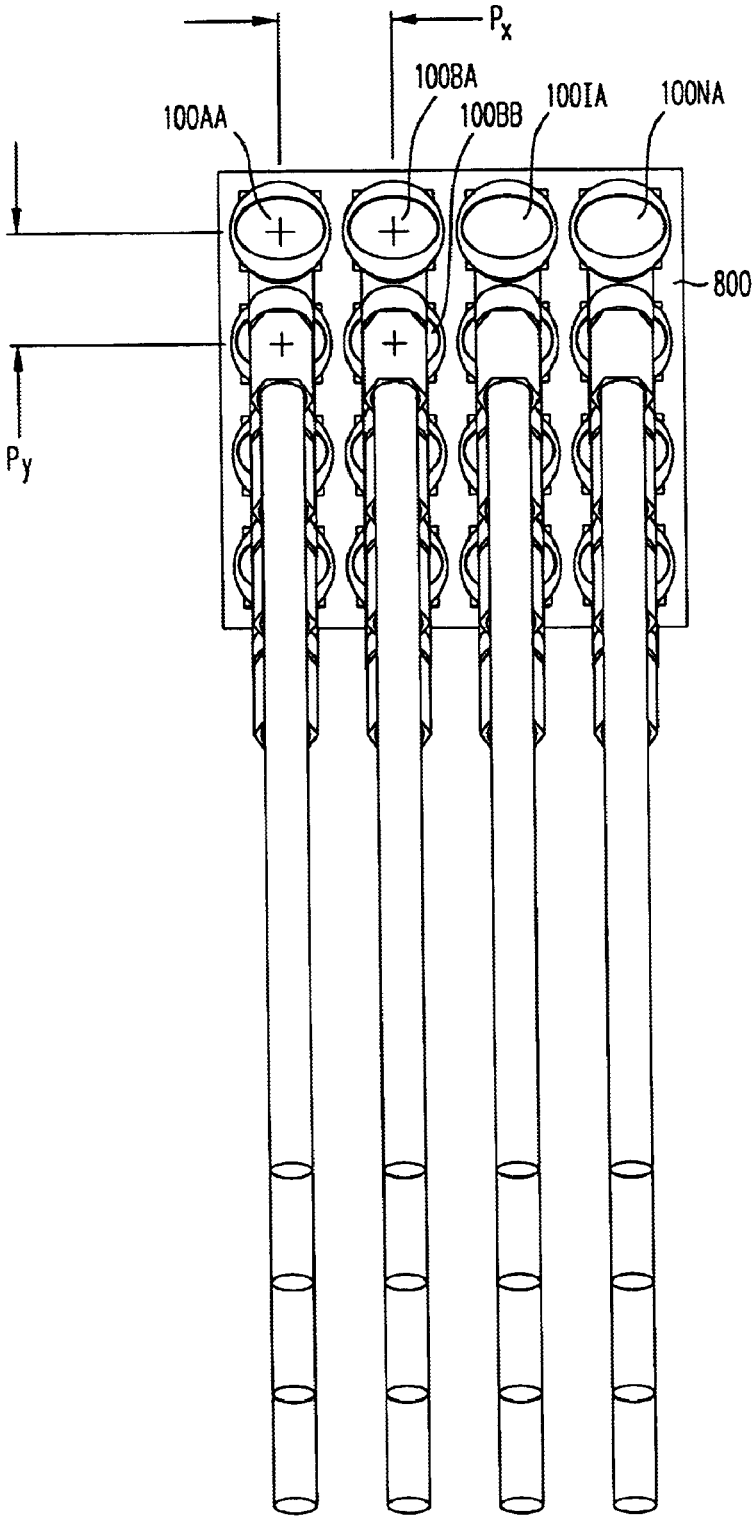
FIG. 4 shows a front view of columns and rows of the SMB plugs of FIG. 1 mounted to a printed circuit board in one embodiment.

FIG. 4 shows a front views of columns and rows of plugs 100 mounted on PCB 800. In one embodiment, columns of plugs 100 are separated by pitch PX (e.g., 0.350 inches) and rows of plugs 100are separated by pitch $P_y$ (e.g., 0.350 inches). Plugs 100 in each column have their wire exits 114 oriented in the same direction (for example, in a downward direction).

As previously described, each plug 100 can rotate at least 90° to the right or the left without interfering with another plug 100 in the same column because of clearance 200. In any case, a single plug 100 can be removed from PCB 800 by merely rotating instead of removing other plugs 100. Similarly, each plug 100 can be mounted to PCB 800 without dismounting other plugs 100 on PCB 100.

Although the invention has been described with reference to particular embodiments, the description is a representative example and should not be taken as limiting. For example, main body 102 and wire exit 114 may be made of non-tubular shapes. In addition, it may be possible to use an angled male SMB coaxial jack with a straight female SMB plug instead of an angled female SMB plug with a straight SMB jack. Furthermore, the angle between main body 102 and wire exit 114 can be selected to be any angle other than 0° and 900. The 0° angle results in a straight connector of the prior art, and use of a number of such connectors in a two dimensional array is limited by the attendant difficulty in managing cables that exit straight out of the connectors. The 90° angle results in a right angled connector of the prior art, and a number of such connectors cannot be mounted in a two dimensional array of equally spaced rows and columns due to cables that exit parallel to a board on which the 90° connectors are mounted. These problems are eliminated by use of a connector that is angled (at, e.g. 30°, 45°, or 60°) relative to the board.

Angles much above 75° do not produce much gain in the decreased protrusion off the PCB. Angles below 25° require such a small diameter C that "off the shelf" cables can not be used. Table 1 below lists additional angles $A_C$ and corresponding maximum diameters C for plug 100 in other embodiments.

TABLE 1

| Angle $A_c$ | Maximum diameter C. |
|---|---|
| 25° | 0.120" |
| 30° | 0.150" |
| 35° | 0.175" |
| 40° | 0.185" |
| 45° | 0.200" |
| 50° | 0.220" |
| 60° | 0.250" |
| 75° | 0.280" |

Various other adaptations and combinations of features of the embodiments disclosed are within the scope of the invention. Numerous embodiments are encompassed by the following claims.

What is claimed is:

1. A connector assembly, comprising:

a printed circuit board;

a plurality of identical straight jacks mounted to the printed circuit in at least one row and at least one column;

a plurality of identical angled plugs mounted to said plurality of straight jacks to form a two dimensional array, each of the angled plugs comprising:

a tubular main body along a first axis, the main body comprising a chamfered end surface and a snap-on coupling mechanism for connecting the plug to a jack;

a tubular wire exit extending from the main body along a second axis, the second axis being parallel to the chamfered end surface and approximately at a selected angle from the first axis, the tubular wire exit having a second diameter C that is a smaller percentage of a pitch P than a first diameter B of the tubular main body, wherein pitch P is smaller of a pitch Px along the row and a pitch Py along the column;

wherein each of the angled plugs can independently rotate without interfering with other angled plugs in the two dimensional array.

2. The connector assembly of claim 1 wherein the selected angle is approximately forty five degrees (45°).

3. The connector assembly of claim 1, wherein the plug conforms to SMB.

4. The connector assembly of claim 1, wherein:

the first diameter B is at most 89 percent of pitch P.

5. The connector assembly of claim 4, wherein:

the second diameter C is at most 59 percent of pitch P.

6. The connector assembly of claim 1 wherein the selected angle is between 25° and 75°.

7. The connector assembly of claim 1 wherein the selected angle is 45°.

8. The connector assembly of claim 1 wherein the two dimensional array has equally spaced rows and columns.

9. A method for mounting and dismounting plugs to and from a printed circuit board, the method comprising:

mounting said plugs to a plurality jacks arranged on the printed circuit board to form a two dimensional array having a pitch P, wherein each plug being mounted comprises a main body and a wire exit, each wire exit extending approximately 45 degrees from the main body, each plug comprising (a) a tubular main body of a first diameter B that is approximately 89 percent of pitch P and (b) a tubular wire exit extending from the main body, the tubular wire exit having a second diameter C that is approximately 59 percent of pitch P, whereby each plug can independently rotate by at least 90° to the left or right without interfering with adjacent plugs;

rotating in different directions, a plurality of first plugs mounted on the jacks, thereby to make room for access to a second plug; and unplugging the second plug from a jack without affecting any of the first plugs.

10. The method of claim 9, further comprising:

rotating a third plug so its wire exit will not interfere with a fourth plug yet plugged in; and plugging in the fourth plug.

11. A method for dismounting plugs from a printed circuit board, the method comprising:

rotating a plurality of first plugs in a two dimensional array, each of the plugs comprising a main body extending along a first axis and a wire exit extending along a second axis at a selected angle from the first axis, each plug being rotated along the first axis and after rotation each first plug's wire exit does not interfere with a space through which a second plug in the two dimensional array is to be removed; and unplugging the second plug from the printed circuit board and removing the second plug through said space without affecting any of the first plugs.

12. The method of claim 11, further comprising:

rotating a third plug so its wire exit does not interfere with a fourth plug yet to be plugged in; and plugging in the fourth plug on the printed circuit board.

13. The method of claim 11 wherein the selected angle is between 25° and 75°.

14. The method of claim 11 wherein the selected angle is 45°.

15. The method of claim 11 wherein the two dimensional array has equally spaced rows and columns.

16. The method of claim 11 wherein:

the wire exit has a first diameter that is a smaller percentage of a pitch P than a second diameter of the main body; and said pitch P is smaller of a first pitch along a row and a second pitch along a column of the two dimensional array.

* * * * *